United States Patent [19]

Wohlwend

[11] Patent Number: 4,552,227

[45] Date of Patent: Nov. 12, 1985

[54] RECIPROCATING LINEAR FLUID MOTOR

[75] Inventor: Maurice Wohlwend, Seattle, Wash.

[73] Assignee: The Stanley Works, New Britain, Conn.

[21] Appl. No.: 641,720

[22] Filed: Aug. 16, 1984

Related U.S. Application Data

[62] Division of Ser. No. 331,650, Dec. 17, 1981, Pat. No. 4,466,493.

[51] Int. Cl.[4] ..... F01B 25/04; F01L 25/04

[52] U.S. Cl. ..... 173/15; 173/119; 173/134; 91/165; 91/220; 91/320

[58] Field of Search ..... 91/220, 300, 165, 320; 173/13, 119, 134, 15

[56] References Cited

U.S. PATENT DOCUMENTS 3,712,179 1/1973 Hanson ..... 91/220

3,766,830 10/1973 Montabert ..... 91/300

4,230,019 10/1980 Caston ..... 91/220

4,380,901 4/1983 Rautimo et al. ..... 91/220

*Primary Examiner*—Paul E. Maslousky

*Attorney, Agent, or Firm*—Joan H. Pauly; Delbert J. Barnard

[57] ABSTRACT

Hydraulic fluid pressure moves a piston (22) against a body of incompressible fluid (14), compressing a spring (42). The pressure is released, and the force of the stored energy in the spring (42) is transmitted to the piston (22) by the body of fluid (14) and drives the piston (22) through its power stroke. The fluid (14) is vented to an outlet (8) before the piston (22) reaches the end of its power stroke, removing the force from the piston (22) and allowing it to free travel through the remainder of the stroke. When the motor (2) is operating and the load is removed from the piston (22), the hydraulic fluid inlet (10) is short-circuited to the outlet (8) and the motor (2) automatically shuts off.

17 Claims, 10 Drawing Figures

RECIPROCATING LINEAR FLUID MOTOR

This is a division of application Ser. No. 331,650, filed Dec. 17, 1981, now U.S. Pat. No. 4,466,493.

DESCRIPTION

1. Technical Field

This invention relates to reciprocating linear motors, and more particularly to the provision of such a motor in which the drive force is removed from the piston or hammer before it reaches the end of its power stroke and which automatically shuts off when the load is removed from the piston or hammer.

2. Background Art

The body of technology relating to reciprocating linear fluid motors is quite large. Various ways of moving a piston or working member through a power stroke have been employed, including the direct application of hydraulic fluid pressure and the releasing of energy stored in a spring. Whatever means is employed, it is generally desirable to check the movement of the piston or working member before the end of the power stroke to reduce the recoil of the motor and to prevent mechanical damage to the motor. The present invention accomplishes this by venting an incompressible fluid which transmits a drive force to the piston, thereby removing the drive force from the piston and allowing the piston to free travel and come to a stop against an oil cushion trapped axially between a piston surface and a housing surface.

Examples of other ways of checking the movement of the piston are disclosed by U.S. Pat. No. 3,487,752, granted Jan. 6, 1970, to D. R. James; and U.S. Pat. No. 3,739,863, granted June 19, 1973, to Maurice Wohlwend. The machine disclosed by U.S. Pat. No. 3,487,752 includes a piston with a stepped surface that moves into a counterbore in the reciprocating cavity, producing a dash pot or hydraulic spring effect, depending on how closely the stepped surface fits into the counterbore. The motor disclosed by U.S. Pat. No. 3,739,863 includes a cup-like member that isolates the piston from the drive force of a gas spring before the piston reaches the end of its power stroke, allowing it to coast to a stop against an oil cushion trapped axially between a piston surface and a housing surface.

It is also generally desirable to provide means for automatically shutting off the motor should the load be removed from the working member. In the present invention, the piston drops down to a shut-off position when the load is removed, opening a short circuit between the fluid inlet and the fluid outlet. In the machine disclosed by U.S. Pat. No. 3,782,483, granted Jan. 1, 1974, to George C. Wandell, the piston drops down below its working stroke, closing a valve and, therefore, cutting off the working fluid. In the hydraulic apparatus disclosed by U.S. Pat. No. 4,281,587, granted Aug. 4, 1981, to Jose T. Garcia-Crespo, the piston drops down below its working stroke, opening a complex system of passageways that discharges the accumulator, leaving the return hydraulic chamber devoid of pressure to move the piston.

The above described patents, together with the prior art that was cited and considered by the Patent Office before granting them, as listed on such patents, should be carefully considered for the purpose of properly evaluating the subject invention and putting it into proper perspective relative to the prior art.

DISCLOSURE OF THE INVENTION

Motors of the present invention characteristically comprise a housing with a longitudinal cavity in which an elongated member reciprocates linearly. A first drive means exerts a force on the elongated member tending to forcibly move it endwise through the longitudinal cavity toward a lower position. A second drive means is provided for forcibly moving the elongated member in the opposite direction toward an upper position. In its preferred form, the motor comprises a spring powered impact tool in which the elongated member is a hammer that is driven by the first drive means into impacting contact with an impact member, driving the impact member against a load. The first drive means includes an expansible fluid chamber formed by one end of the longitudinal cavity, which fluid chamber is in pressure communication with a gas spring that provides the drive force for driving the hammer against the impact member. The second drive means comprises a hammer return hydraulic system for driving the hammer against the fluid chamber and compressing the spring. The hydraulic system includes means for alternately directing hydraulic fluid pressure against the hammer and exhausting hydraulic fluid pressure from the hammer to allow the spring to drive the hammer against the impact member. Preferably, the means for directing hydraulic fluid pressure comprises a single linear reciprocating valve. This valve is moved back and forth between two positions by the hydraulic fluid pressure in the hydraulic system.

The primary object of this invention is to provide a linear reciprocating motor that operates efficiently and safely.

An important feature of the invention that relates to the primary object is the provision of means for diverting the force of the first drive means away from the elongated member before said member reaches its lower position, so that the elongated member free travels before coming to a stop in its lower position and reversing its direction of movement. The force is diverted by venting incompressible fluid in a fluid chamber that forms part of the first drive means. Since the fluid acts on and transmits the driving force to the elongated member, venting it removes the driving force from the elongated member, thereby reducing the recoil of the motor, preventing excessive shock and mechanical damage to the motor, and allowing the elongated member to stop in its lower position so that the second drive means can move it toward its upper position.

Another important feature of the invention relating to the primary object is the provision of stop means for automatically shutting off the motor when the load is removed from the elongated member. The stop means includes passageway means for short-circuiting hydraulic fluid pressure from the fluid inlet directly to the fluid outlet. When the motor is operating, the passageway means is blocked by the elongated member. In the preferred embodiment of this feature, the fluid inlet and the fluid outlet are short-circuited via the fluid chamber that forms part of the first drive means.

These and other objects, advantages and features will become apparent from the detailed description of the best mode for carrying out the invention that follows.

BRIEF DESCRIPTION OF THE DRAWINGS

In the drawings, like element designations refer to like parts throughout, and.

BEST MODE FOR CARRYING OUT THE INVENTION

Figure 1:
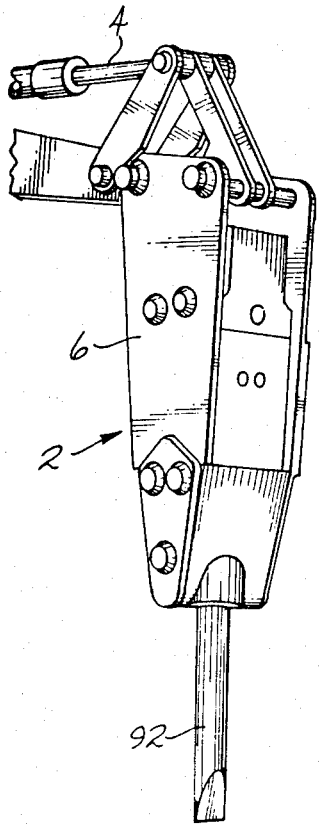
FIG. 1 is a pictorial view of a preferred embodiment of the invention.

The drawings show a motor 2 that is constructed according to the invention and that also constitutes the best mode of the invention currently known to the applicant. The motor of the preferred embodiment is an impact, or breaker tool 2 adapted to be attached to the end of a boom 4 carried by a piece of power equipment, such as an earthworking machine. The breaker tool 2 can easily be connected to the hydraulic system of such equipment. When so connected, the breaker tool 2 and the power equipment form a complete system, and there is no need to bring any other breaker or hydraulic equipment to the work site. The breaker tool 2 is only one type of machine which can effectively utilize the motor of this invention, and it is to be understood that the motor of this invention has general utility and can be used in any of the variety of situations requiring a motor with the characteristics of this invention.

The breaker tool 2 has a housing 6 which includes an elongated longitudinal cavity 12. This cavity 12 is defined in part by a transverse wall 18 formed by the housing 6. An elongated piston, or hammer 22 reciprocates linearly in the longitudinal cavity 12 and is driven through a power stroke against an impact member 92, such as a moil, which is in line with the hammer 22 and is driven by the hammer 22 against a load. The hammer 22 has an upper end 24 and a piston portion 26, both of which are confined in the longitudinal cavity 12. The piston portion has a pressure surface 26 which, when the tool 2 is operating, is spaced longitudinally from the transverse wall 18 formed by the housing 6 and is in fluid communication with such wall 18.

The hammer 22 is driven through its power stroke by drive means that is in line with the hammer 22 and exerts a force on the upper end 24 of the hammer 22 tending to forcibly move the hammer 22 endwise through the longitudinal cavity 12. As the hammer 22 moves through the longitudinal cavity 12 in its power stroke, the pressure surface 26 on the piston portion moves towards the transverse wall 18. In the preferred embodiment, the drive means comprises an expansible fluid chamber 14 filled with an incompressible hydraulic fluid and a gas spring 42 in pressure communication with the fluid chamber 14. The chamber 14 is formed by one end of the longitudinal cavity 12 adjacent to the upper end 24 of the hammer 22. When pressure is applied to the incompressible fluid in the chamber 14, the gas spring 42 is compressed and energy is stored therein for driving the hammer 22 through its power stroke. Although this is the preferred embodiment, the principles of this aspect of the invention may be used to advantage in any motor with drive means that includes a body of incompressible fluid that acts on and transmits a drive force to the hammer or piston. An example of another possible embodiment of the drive means is one which substitutes a mechanical spring for the gas spring 42 of the preferred embodiment.

In the preferred embodiment, the gas spring 42 includes a sealed gas chamber 42 positioned above the upper end of the longitudinal cavity 12 which forms the fluid chamber 14. This gas chamber 42 is expansible toward the fluid chamber 14 and is filled with a compressible gas, such as nitrogen. The gas chamber 42 and the fluid chamber 14 are separated by a diaphragm 44, and the outer volume limit of the gas chamber 42 is defined by a rigid wall 46 with a multiplicity of regularly spaced openings.

The body of fluid 14 transmits the force of the energy stored in the gas spring 42 to the upper end 24 of the hammer 22 to drive the hammer 22 through its power stroke. In order to reduce the recoil of the housing 6 and to prevent the hammer 22 from being driven against a part of the housing 6, the drive force transmitted to the hammer 22 by the body of incompressible fluid 14 is diverted from the hammer 22 just before it strikes the impact member 92 and reaches the end of its power stroke. The force is so diverted before the pressure surface 26 on the piston portion of the hammer 22 reaches the transverse wall 18 formed by the housing 6. Therefore, the pressure surface 26 is not driven hard against the transverse wall 18, and the hammer 22 free travels before coming to a stop, with a minimum recoil, and reversing its direction of movement. The means for accomplishing the diversion comprises a fluid outlet 8 and an arrangement of passageways which, when open, communicates the fluid chamber 14 with the fluid outlet 8. The arrangement of passageways closes in response to movement of the hammer 22 in opposition to the force of the gas spring 42 and opens in response to movement of the hammer 22 in the direction of such force. As the body fluid 14 is vented through the fluid outlet 8, the expansion of the gas spring 42 is limited by the rigid wall 46, which defines the outer volume limit of the gas chamber 42. Therefore, the force of the gas spring 42 cannot counterbalance the release of pressure caused by the venting, and the drive force is effectively diverted.

In order to drive the hammer 22 endwise through the longitudinal cavity 12 toward the fluid chamber 14 in opposition to the force of the gas spring 42 and store energy in the gas spring 42 for the power stroke, it is necessary to provide a second drive means. In the motor 2 of the preferred embodiment, this second drive means is a hydraulic system which regulates the flow of a hydraulic fluid to and away from the pressure surface 26 of the piston portion of the hammer 22. The flow is regulated by means of a control valve 60 which is movable between a first position in which the hydraulic fluid is admitted to the pressure surface 26 and a second position in which the hydraulic fluid is exhausted from the pressure surface 26. When hydraulic fluid is being admitted to the pressure surface 26, it exerts hydraulic fluid pressure on such surface 26 for moving the hammer 22 to its upper position and moving the upper end 24 of the hammer 22 against the fluid chamber 14, thereby compressing the gas spring 42. When hydraulic fluid is being exhausted from the pressure surface 26, there is no hydraulic fluid pressure acting on the hammer 22 in opposition to the force of the gas spring 42. Therefore, the force of the stored energy in the gas spring 42, transmitted to the hammer 22 by the body of incompressible fluid 14, forcibly moves the hammer 22 endwise through the longitudinal cavity 12 and the pressure surface 26 toward the transverse wall 18.

As stated above, the drive force is diverted from the hammer 22 before it reaches the end of its power stroke and comes to a stop in its lower position. This is accomplished by an arrangement of passageways which opens and closes in response to the movement of the hammer 22. The arrangement includes an annular passageway 34 surrounding the end of the longitudinal cavity 12 which forms the fluid chamber 14. The annular passageway 34 communicates with the fluid outlet 8. A plurality of circumferentially spaced openings 32, in the preferred embodiment four openings, are ported on an inner surface of the longitudinal cavity 12 and communicate with the annular passageway 34. These openings 32 are in sliding contact with the hammer 22 when the arrangement of passageways is closed and in open communication with the fluid chamber 14 when the arrangement of passageways is open. In other words, when the hammer 22 moves toward its upper position, it blocks the openings 32 ported on the longitudinal cavity 12 sealing the incompressible fluid in the fluid chamber 14; and when the hammer 22 moves back down to its lower position, it moves past the openings 32 ported on the longitudinal cavity 12 thereby opening communication between the fluid chamber 14 and the fluid outlet 8. This communication vents the incompressible fluid and removes the drive force from the hammer 22. The hammer 22 then free travels and comes to a stop in its lower position.

The longitudinal cavity 12 also includes a drive chamber 16 between the transverse wall 18 formed by the housing 6 and the pressure surface 26 of the piston portion of the hammer 22. This drive chamber 16 contains an incompressible fluid when the motor 2 is in operation, and such incompressible fluid provides a cushioning stop for the hammer 22 as the pressure surface 26 approaches the transverse wall 18.

The housing 6 includes a fluid inlet 10 for introducing hydraulic fluid pressure into the motor 2 to move the hammer 22 toward its upper position and reciprocate the control valve 60 back and forth between its first and second positions. The control valve 60 has a first end surface 54 which is in pressure communication with the fluid inlet 10 and receives an endwise force from inflowing hydraulic fluid tending to move the control valve 60 into its first position. The hydraulic system includes conduit means for delivering hydraulic pressure to the control valve 60 when the hammer 22 has moved a predetermined distance toward its upper position. This moves the control valve 60 into its second position and holds it there until the hammer 22 has moved through most of its power stroke and the pressure surface 26 has moved a predetermined distance towards the transverse wall 18. Then the control valve 60 starts to move back to its first position, and it reaches that position after the hammer 22 completes the drive stroke.

In the preferred embodiment, the control valve comprises a valve spool 60 which reciprocates linearly in a guide cavity 11 formed in the housing 6 and spaced from the longitudinal cavity 12. The first end surface 54 of the valve spool 60 is in pressure communication with the fluid inlet 10. Hydraulic fluid pressure from the fluid inlet 10 is communicated to this first end surface 54 via two pressure passageways 56 in which the hydraulic fluid pressure acts on two pins 58 which transmit the pressure to the first end surface 54. Each of the two pins 58 has a pressure end which is closely received in the corresponding pressure passageway 56 and a contact end which makes contact with the first end surface 54 of the valve spool 60. The contact ends of the pins 58 make contact with opposite portions of the first end surface 54 of the valve spool 60, diametrically opposed portions in the case of a cylindrical valve spool, such as the one shown in the drawings.

The conduit means which delivers hydraulic fluid to the valve spool 60 of the control valve opens and closes in response to the reciprocating movement of the hammer 22. The hammer 22 has a galley portion 28 and a land portion 30 adjacent to the galley portion 28. The conduit means includes a transmitting galley 62 defined by the galley portion 28 of the hammer 22 and part of the inner surface of the longitudinal cavity 12. This transmitting galley 62 is in pressure communication with the fluid inlet 10. The conduit means also includes a first sidewall passageway 64 with a first end directed toward the valve spool 60 and a second end ported on the longitudinal cavity 12. This second end ported on the longitudinal cavity 12. This second end is closed when the land portion 30 of the hammer 22 is adjacent to and in sliding contact with it and opens when the land portion 30 moves past it as the upper end 24 of the hammer 22 moves against the fluid chamber 14 of the drive means bringing the second end into communication with the transmitting galley 62. The result of this communication is that hydraulic fluid pressure is delivered from the fluid inlet 10 to the valve spool 60. The transmitting galley 62 is in communication with the fluid inlet 10 via a valve galley 66 defined by a reduced width portion of the valve spool 60 and a portion of the inner surface of the guide cavity 11, a pressure passageway 68 which communicates the fluid inlet 10 and the valve galley 66, and a second sidewall passageway 70 which communicates the valve galley 66 and the transmitting galley 62.

The first end of the first sidewall passageway 64, which is directed toward the valve spool 60, is in open communication with an expansible pressure galley 72 surrounding a portion of the valve spool 60. Such portion of the valve spool 60 is adjacent to an increased width portion of the spool 60 which has a transverse surface that partly defines the expansible pressure galley 72. Since the pressure galley 72 is in open communication with the first end of the first sidewall passageway 64, when the second end of the first sidewall passageway 64 is in communication with the transmitting galley 62, hydraulic fluid is delivered to the pressure galley 72. In the pressure galley 72, the hydraulic fluid exerts a force on the transverse surface and moves the valve spool 60 up toward its second position. The force on the transverse surface is sufficient to overcome the opposite force transmitted to the first end surface 54 of the valve spool 60 by the pins 58 because the area of the transverse surface is larger than the combined area of the pressure ends of the pins 58.

The conduit means that delivers hydraulic fluid pressure to the valve spool 60 further includes a third sidewall passageway 82 with a first end that is ported on the longitudinal cavity 12 below the first sidewall passageway 64 and a second end that is directed toward the valve spool 60. This first end is adjacent to the land portion 30 of the hammer 22 when the hammer 22 is in its lower position and slidingly opens into commuication with the transmitting galley 62 as the hammer 22 moves toward its upper position. This occurs before communication between the transmitting galley 62 and the first sidewall passageway 64 is opened because the third sidewall passageway 82 is ported below the first sidewall passageway 64. The second end of the third sidewall passageway 82 communicates with the pressure galley 72 when the valve spool 60 is more than a predetermined distance from its first position and is closed by the increased width portion of the valve spool 60 when the valve spool 60 is within such distance from its first position. In other words, the second end of the third sidewall passageway 82 opens into communication with the pressure galley 72 as the valve spool 60 is moved up toward its second position by the hydraulic fluid admitted to the pressure galley 72 through the first sidewall passageway 64, and it is closed by the increased width portion of the valve spool 60 as the spool 60 moves back down toward its first position. When the third sidewall passageway 82 is in communication with the pressure galley 72 and the transmitting galley 62, it delivers hydraulic fluid pressure to the pressure galley 72 from the fluid inlet 10 via the transmitting galley 62, the second sidewall passageway 70, the valve galley 66, and the pressure passageway 68.

It should be apparent that the conduit means comprises primary and secondary means for moving the valve spool 60 into its second position. The primary means is the delivery of hydraulic fluid pressure to the pressure galley 72 through the first sidewall passageway 64. This moves the valve spool 60 up said predetermined distance so that the increased width portion of the valve spool 60 clears the second end of the third sidewall passageway 82. Then the secondary means, the delivery of hydraulic fluid pressure to the pressure galley 72 through the third sidewall passageway 82, is activated. The primary and secondary means cooperate to move the valve spool 60 up the rest of the way to its second position and hold it there until the land portion 30 of the hammer 22 closes the second end of the first sidewall passageway 64 as the hammer 22 moves down toward its lower position. After the first sidewall passageway 64 is closed, the secondary means continues to hold the valve spool 60 in its second position until the land portion 30 of the hammer 22 closes the first end of the third sidewall passageway 82. With both the primary and the secondary means cut off, the valve spool 60 starts to move back down to its first position, which it reaches just after the hammer 22 completes the drive stroke. The combination of the primary and secondary means moves the valve spool 60 up quickly and efficiently and holds it up until the power stroke is near completion but requires only a small amount of hydraulic fluid.

One end of the guide cavity 11 forms a valve seat 76. The second end surface 74 of the valve spool 60 and the lower part of a land portion 78 of the valve spool 60, which is adjacent to the second end surface 74, sealingly contact the valve seat 76 when the valve spool 60 is in its first position and are spaced from the valve seat 76 when the spool 60 is in its second position. An exhaust passage 80 extends through the valve spool 60 and is ported on the first and second end surfaces 54, 74 of the spool 60. This exhaust passage 80 is in open communication with the fluid outlet 8 via an exhaust manifold, or galley 20, which is described below, and passageway 99.

A portion of the longitudinal cavity 12 forms an expansible drive chamber 16 defined in part by the pressure surface 26 of the piston portion of the hammer 22 and the transverse wall 18 formed by the housing 6. When the motor 2 is operating and the valve spool 60 is in its first position, the drive chamber 16 is in communication with the valve galley 66 and hydraulic fluid pressure is admitted to the pressure surface 26 from the fluid inlet 10. The hydraulic fluid pressure acts on the pressure surface 26 and moves the hammer 22 toward its upper position. When the valve spool 60 moves toward its second position a sufficient distance so that the second end surface 74 and the lower part of the land portion 78 of the valve spool 60 clear the valve seat 76, the drive chamber 16 opens into communication with the exhaust passage 80 and hydraulic fluid pressure is exhausted from the pressure surface 26 through the exhaust passage 80 to the fluid outlet 8. At the same time, the land portion 78 blocks the drive chamber 16 from communication with the valve galley 66 and, thus, prevents any further hydraulic fluid pressure from being admitted to the pressure surface 26. The second end surface 74 does not clear the valve seat 76, allowing the hydraulic fluid pressure to exhaust from the pressure surface 26, until the secondary means for moving the valve spool 60 up has been activated. This slight delay provides extra insurance that the valve spool 60 will move up and the motor 2 will operate smoothly and efficiently.

As stated above, the hydraulic fluid pressure in the pressure galley 72 holds the valve spool 60 in its second position until the land portion 30 of the hammer 22 closes off the third sidewall passageway 82 as the hammer 22 moves toward its lower position. At about the same time that passageway 82 is closed off, the second end of the first sidewall passageway 64 opens into communication with an expansible exhaust galley 20 surrounding a reduced width portion 31 of the hammer 22, which portion 31 is adjacent to the land portion 30 of the hammer 22. The exhaust galley 20 is defined by such reduced width portion 31 of the hammer 22 and by a portion of the longitudinal cavity 12 and is in open communication with the fluid outlet 8 via passageway 99. As the pressure surface 26 approaches the transverse wall 18, the land portion 30 of the hammer 22 moves past the second end of the first sidewall passageway 64 and the exhaust galley 20 expands coming into open communication with such second end. Hydraulic fluid pressure is exhausted from the transverse surface of the valve spool 60, and the valve spool 60 is moved into its first position by hydraulic fluid pressure acting on the pressure ends of the two pins 58. Once the valve spool 60 has again reached its first position, hydraulic fluid pressure is again admitted to the pressure surface 26 of the piston portion of the hammer 22 and the hammer 22 can begin a new cycle.

The valve spool 60 begins to move down to its first position as soon as the third sidewall passageway 82 is closed off even though there is a slight delay before the land portion 30 of the hammer 22 clears the second end of the first sidewall passageway 64. This is possible because the land portion 30 fits fairly loosely in the longitudinal cavity 12. Therefore, once the seal ring 29 on the land portion 30 has cleared the second end of the first sidewall passageway 64, there is sufficient leakage from that passageway 64 into the exhaust galley 20 to release enough pressure from the transverse surface of the valve spool 60 to allow the valve spool 60 to start to move down.

As a safety feature, the motor of this invention is provided with stop means for automatically shutting off the motor when the load is removed from the working member. In the preferred embodiment, this occurs when the load is removed from the impact member 92, such as when the impact member, or moil 92, breaks through the rock or other material on which it is operating. In such a situation, it could be hazardous if the hammer 22 continued to reciprocate.

The stop means includes means for allowing the hammer 22 to slide into a shut-off position when the load is removed from the moil 92. A system of passageways, which is blocked by the hammer 22 when the hammer 22 is in its upper or lower operating position or between such positions, is opened when the hammer 22 slides below its lower position into its shut-off position. The system of passageways directly communicates the fluid inlet 10 and the fluid outlet 8 and creates a short circuit, thereby preventing hydraulic fluid pressure from being directed against the hammer 22. Since the drive force of the hydraulic system is thus removed from the hammer 22, the hammer 22 ceases to reciprocate and the motor 2 shuts off. The principles of the stop means—allowing the working member (hammer 22) to slide into a shut-off position to unblock a short circuit between the fluid inlet and the fluid outlet—obviously could be used to advantage in any reciprocating linear motor in which the working member is driven in at least one direction by hydraulic fluid pressure.

In the preferred embodiment, the system of passageways includes at least one inlet opening 36 ported on the longitudinal cavity 12 and communicating with the fluid inlet 10 and at least one outlet opening 32 ported on the longitudinal cavity 12 and communicating with the fluid outlet 8. When the hammer 22 is in its shut-off position, both the inlet opening 36 and the outlet opening 32 are in open communication with the fluid chamber 14, creating a short circuit between the fluid inlet 10 and the fluid outlet 8. When the motor 2 is operating, the upper portion of the hammer 22 which moves against the fluid chamber 14 blocks communication between the inlet opening 36 and the outlet opening 32.

In the preferred embodiment as shown in the drawings, the system of passageways includes the annular passageway 34 described above, hereinafter referred to as the annular outlet passageway 34, and the four circumferentially spaced openings 32 communicating with said annular outlet passageway 34, hereinafter referred to as the outlet openings 32. Spaced longitudinally below the annular outlet passageway 34 and the outlet openings 32 are an annular inlet passageway 38, which surrounds the end of the longitudinal cavity 12 that forms the fluid chamber 14 and communicates with the fluid inlet 10, and a plurality of circumferentially spaced inlet openings 36 communicating with the annular inlet passageway 38 and ported on the longitudinal cavity 12 below the outlet openings 32. In the preferred embodiment, there are four inlet openings 36, and the annular inlet passageway 38 and the inlet openings 36 have substantially the same shape and dimensions as the annular outlet passageway 34 and the outlet openings 32, except that the total area of the inlet openings is greater than the total area of the outlet openings to maintain fluid pressure within fluid chamber 14.

The inlet openings 36 are in sliding contact with the hammer 22 when the system of passageways is blocked and in open communication with the fluid chamber 14 when the hammer 22 is in its shut-off position. The outlet openings 32 are in sliding contact with the hammer 22 when the hammer 22 is in its upper position and in open communication with the fluid chamber 14 when the hammer 22 is in its lower position or its shut-off position. In other words, when the motor 2 is operating, the inlet openings 36 are blocked by the hammer 22 and the outlet openings 32 open and close as the hammer 22 reciprocates between its upper position and its lower position. When the load is removed, the hammer 22 drops down below its lower position into its shut-off position, unblocking the inlet openings 36 and opening free communication between the inlet openings 36 and the outlet openings 32.

Figure 7:
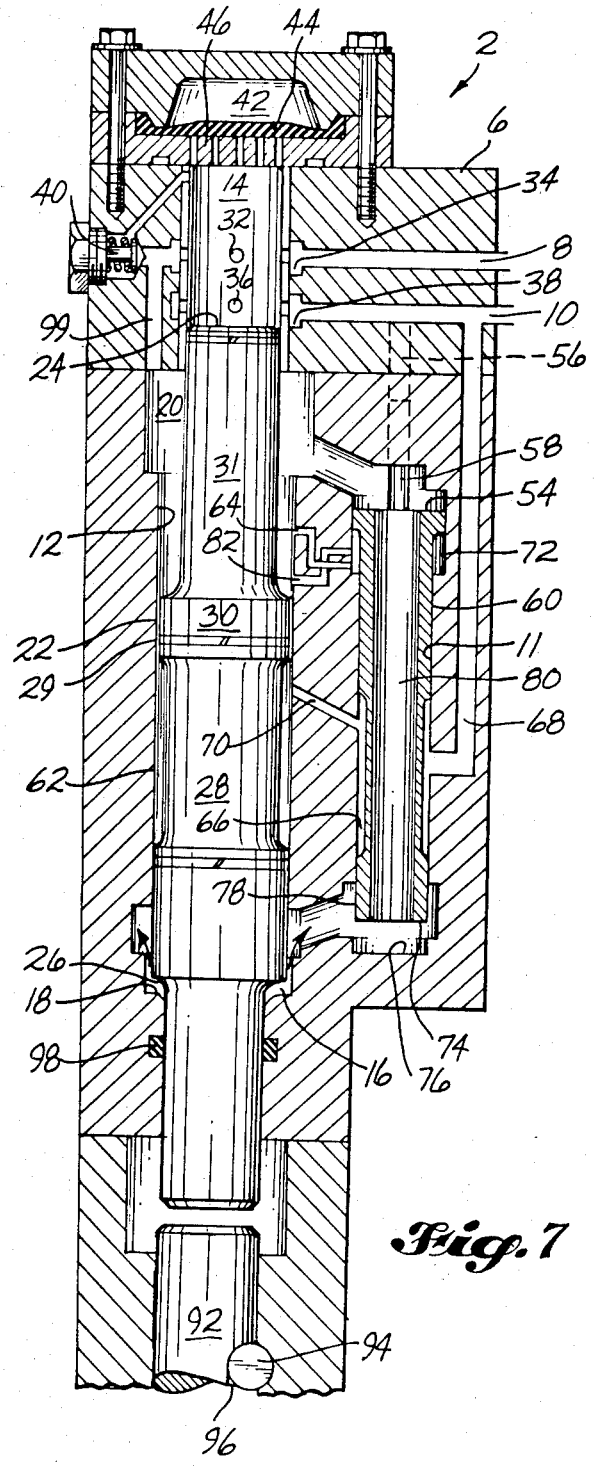
FIG. 7 is a longitudinal sectional view of the preferred embodiment showing the positions of the moil, hammer, and valve immediately after the moil has broken through its load.
Figure 8:
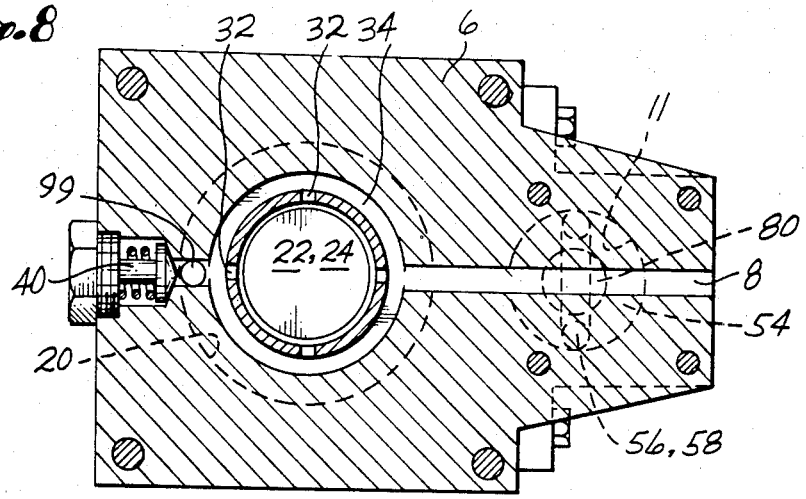
FIG. 8 is a sectional view taken along the line 8—8 of FIG. 2.
Figure 9:
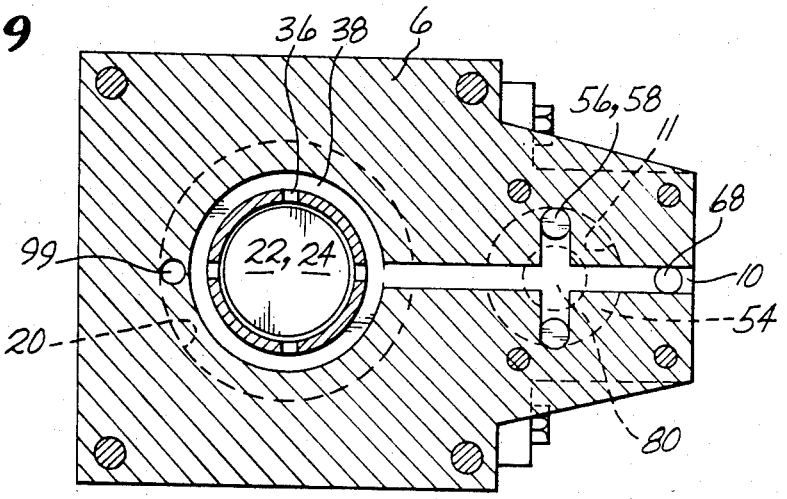
FIG. 9 is a sectional view taken along the line 9—9 of FIG. 2.
Figure 10:
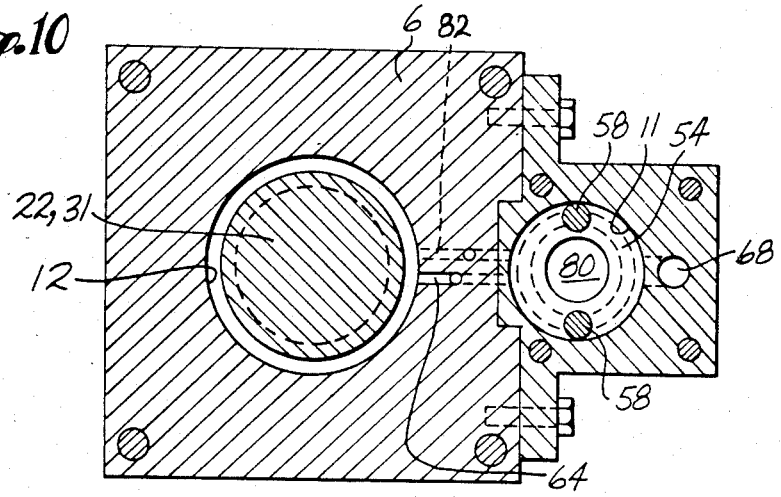
FIG. 10 is a sectional view taken along the line 10—10 of FIG. 2.

When the hammer 22 drops into its shut-off position, it is prevented from forcefully contacting the housing 6, or more specifically the pressure surface 26 is prevented from forcefully contacting the transverse wall 18, by incompressible fluid trapped in the drive chamber 16, which is enclosed by the pressure surface 26, a sidewall of the hammer 22, the transverse wall 18, and a sidewall of the longitudinal cavity 12 when the hammer 22 is sliding toward its shut-off position, as shown in FIG. 7. Since the fit between the side wall of the hammer 22 and the side wall of the longitudinal cavity 12 is loose, the drive chamber 16 acts as a dashpot and the pressure surface 26 settles slowly down into contact with the transverse wall 18.

In order for the hammer 22 to be free to slide into its shut-off position, the moil 92 must slide down into a shut-off position when the load is removed from it so that the hammer 22 no longer contacts the moil 92 at the end of the hammer's power stroke. Therefore, the moil 92 is mounted on the housing 6 in a manner that permits it limited longitudinal movement. In the preferred embodiment, the moil 92 has a longitudinal groove 96, and the housing 6 has a guide member 94 projecting from it, which guide member 94 is in sliding contact with the inner surface of the groove 6 and is adjacent to the lower end of the groove 96 when the moil 92 is against a load and adjacent to the upper end of the groove 96 when the moil 92 is in its shut-off position. A simple way of constructing the guide member 94 is to provide a slot in the housing 6 into which a cross pin 94 is received and secured. One side of the pin 94 projects from the inside of the housing 6 into the groove 96 in the moil 92. This construction not only serves to allow limited longitudinal movement of the moil 92, but also provides a simple means of mounting and removing the moil 92 since the moil 92 will slip out of the housing 6 if the pin 94 is removed.

Another feature of the present invention is the provision of a check valve 40 between the fluid chamber 14 and the exhaust galley 20. As the hammer 22 moves upwardly against the gas spring 42, there is some leakage of hydraulic fluid out of the fluid chamber 14 through the fluid outlet 8. In an ideal motor, such leakage would not occur, but as a practical matter it cannot be entirely prevented. Therefore, it is necesary to provide means for replenishing the hydraulic fluid. This is the purpose of the check valve 40.

If the motor operated in an ideal manner, the pressure in the fluid chamber 14 during the power stroke would not drop below the pressure level in the exhaust galley 20, which since the exhaust galley 20 is in open communication with fluid outlet 8, is equal to the pressure in outlet openings 32 and annular outlet passageway 34. Since the motor does not operate in an ideal manner, the leakage described above causes the pressure in fluid chamber 14 to drop below the pressure level in the exhaust galley 20 during the power stroke before the upper end 24 of the hammer 22 moves past the outlet openings 32, opening communication between the fluid chamber 14 and the fluid outlet 8. This occurs when the diaphragm 44 of the gas spring 42 prematurely expands to its outer limit and lies flat against the rigid wall 46, and is thereby prevented from transmitting any further pressure to the incompressible fluid in the fluid chamber 14. The result is the drop in pressure that has been described. The check valve 40, which is closed at the beginning of the power stroke, opens in response to this drop in pressure and the resulting pressure differential between the fluid chamber 14 and the exhaust galley 20 and compensates for the drop by admitting hydraulic fluid into the fluid chamber 14. The replenishing hydraulic fluid comes from drive chamber 16 and enters fluid chamber 14 via the exhaust passage 80 in the valve spool 60 and exhaust galley 20.

When the upper end 24 of the hammer 22 moves past the outlet openings 32 and thereby opens communication between fluid chamber 14 and the fluid outlet 8, the pressures in fluid chamber 14 and exhaust galley 20 are equalized and the check valve 40 closes since it is biased toward its closed position by a compression spring. The check valve 40 remains closed until the next pressure drop occurs during the next power stroke. Thus, in each power stroke the hydraulic fluid pressure in the fluid chamber 14 is maintained at an appropriate level until the force of the drive means (which includes the gas spring 42) is diverted from the hammer 22 by the opening of communication between fluid chamber 14 and fluid outlet 8.

Motors constructed according to the invention would work without the check valve 40, but their efficiency would be impaired and their useful life would be considerably reduced. If replenishing fluid is not admitted to the fluid chamber 14 near the end of the power stroke, a vacuum effect develops in the chamber 14. The result is cavitation erosion that seriously damages the steel parts of the motor and reduces its useful life. The use of check valve 40 placed between fluid chamber 14 and exhaust galley 20 prevents such unnecessary wear and increases the efficiency and useful life of the motor 2.

Various additional features may also be included in a motor constructed according to the present invention. For example, an annular elastomeric seal 98 may be advantageously positioned around the lower portion of the hammer 22 to prevent leaking of hydraulic fluid out of the motor and introduction of foreign matter into the motor.

Figure 2:
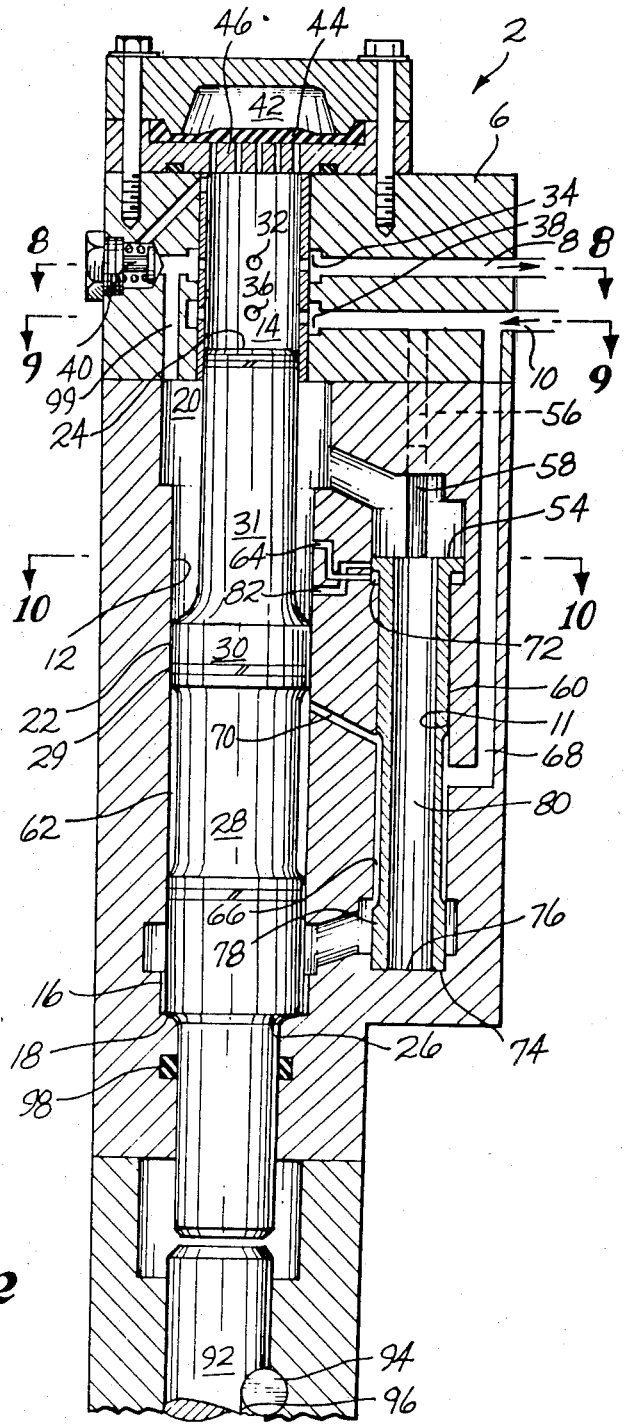
FIG. 2 is a longitudinal sectional view of the preferred embodiment showing the valve and moil down and the hammer in its shut-off position.
Figure 3:
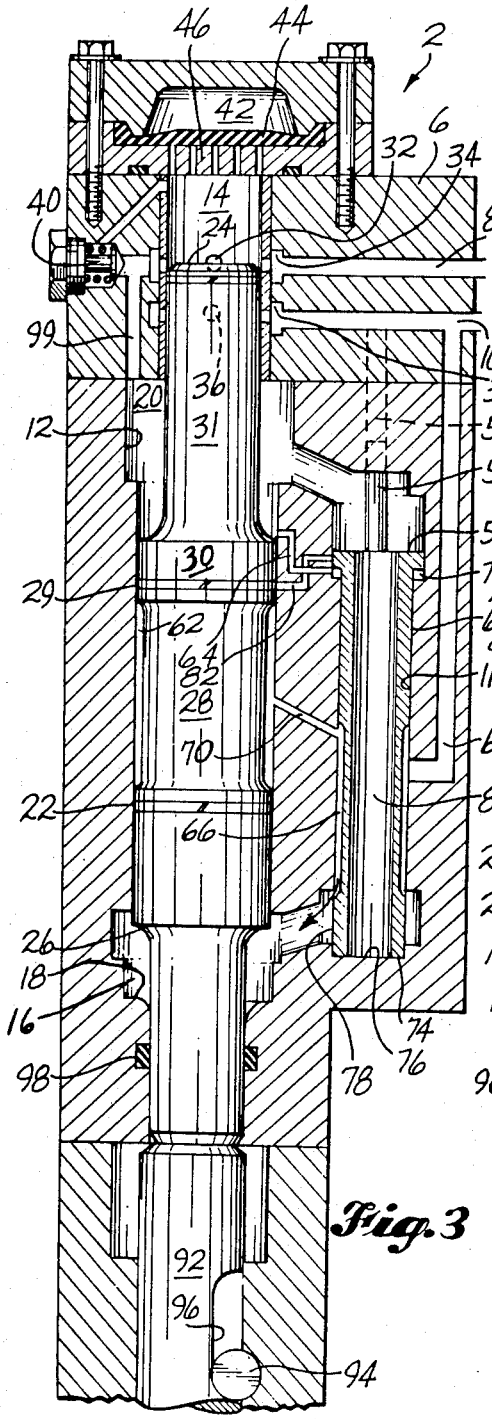
FIG. 3 is similar to FIG. 2 except that the moil has been moved up by placing it on a working surface and the hammer has been moved into its lower operating position by the moil.
Figure 4:
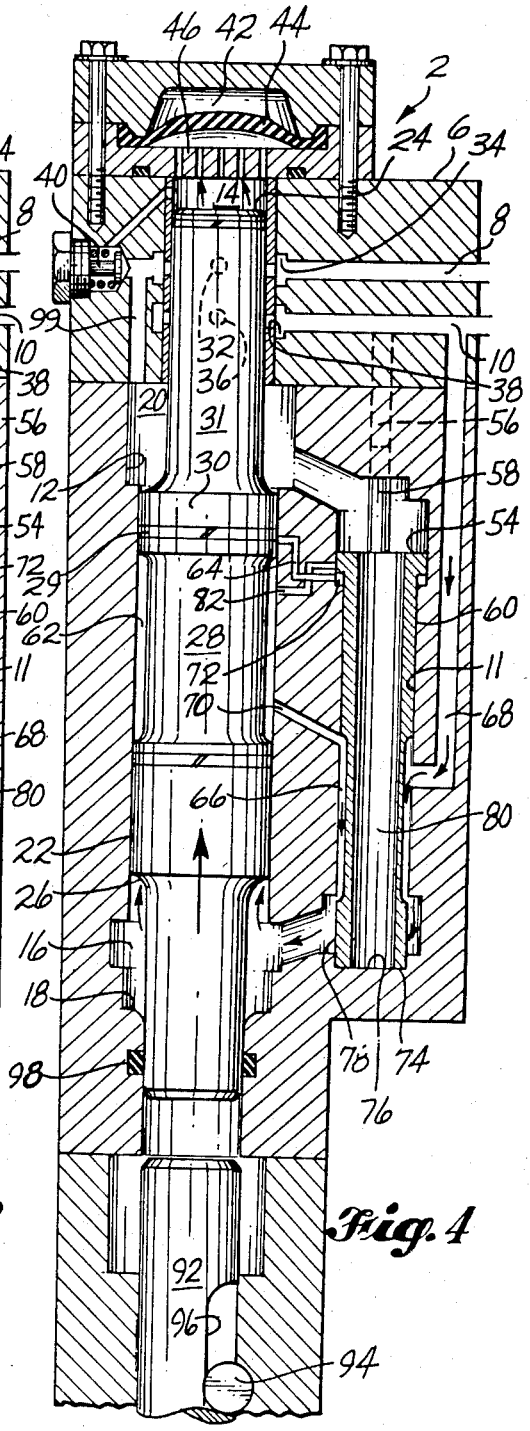
FIG. 4 is similar to FIG. 3 except that hydraulic fluid pressure is moving the hammer up and the gas spring is being compressed.
Figure 5:
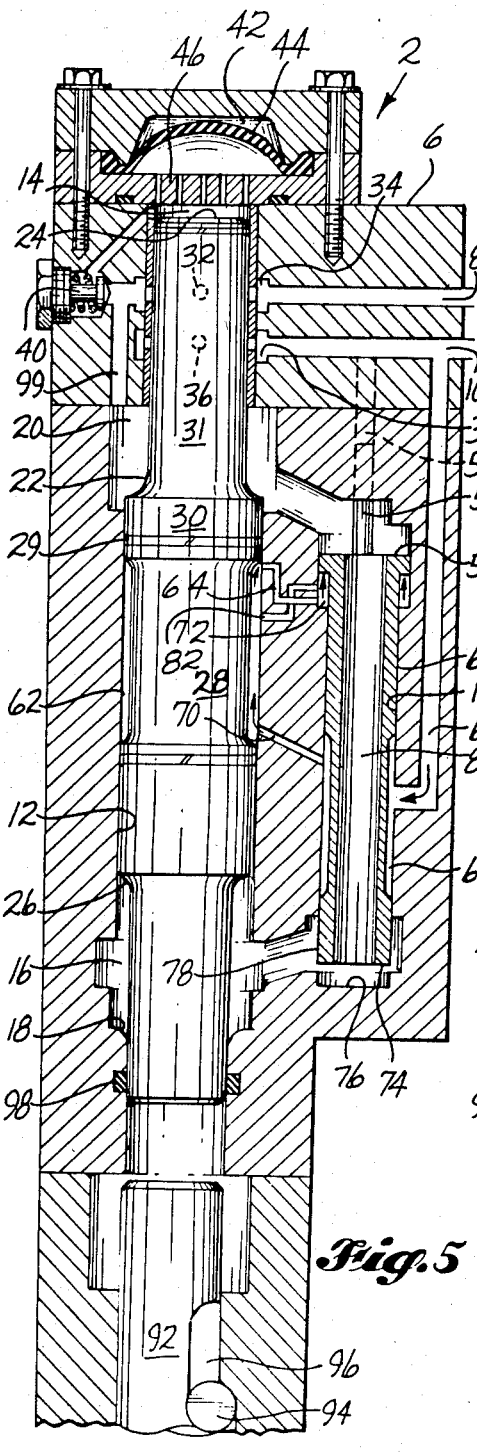
FIG. 5 is similar to FIG. 4 except that the valve is moving up, the hammer has reached its upper position, and the gas spring is just starting to move the hammer down.
Figure 6:
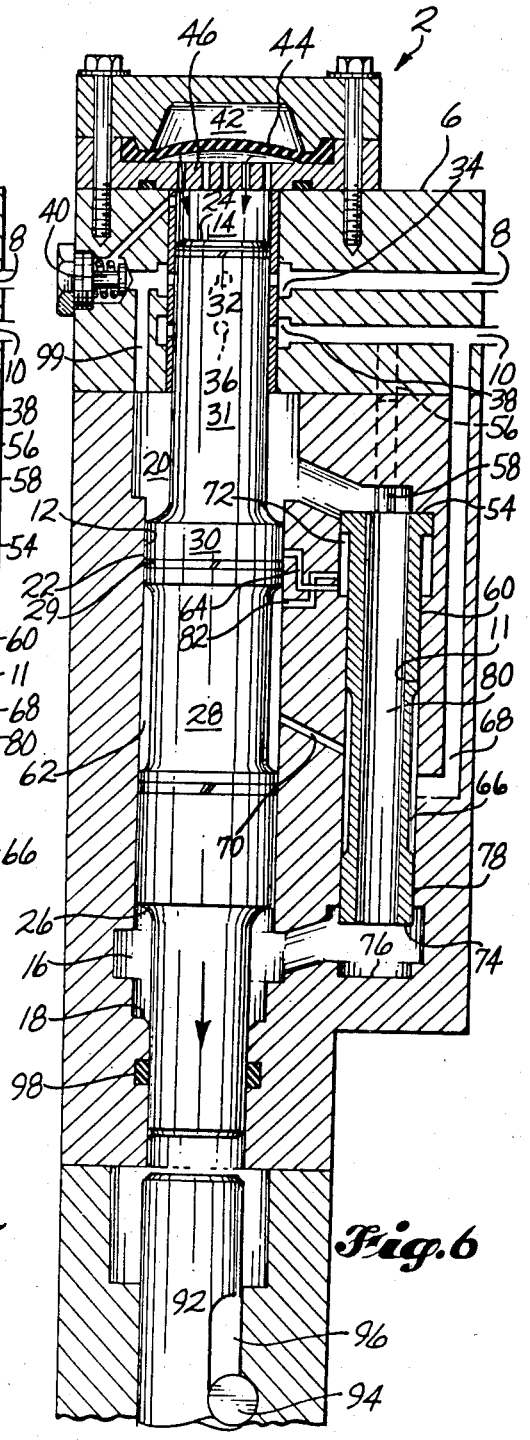
FIG. 6 is similar to FIG. 5 except that the valve is all the way up and the gas spring is driving the hammer down.

The actual operation of the breaker tool 2 is quite simple. The tool 2 need only be attached to a boom 4 carried by a piece of power equipment and connected to the hydraulic system of such equipment as described above. In order to commence operation of the tool 2, the moil 92 is placed on the material on which it is to work. When the moil 92 is so placed, it moves into its upper position, moving the hammer 22 into its lower operating position and closing the inlet openings 36, as shown in FIG. 3. With the hammer 22 so positioned, hydraulic fluid pressure from the hydraulic system of the power equipment acts on the hammer 22 via the pressure passageway 68 and the valve galley 66 and begins to reciprocate the hammer 22. If the moil 92 should break through the material on which it is operating, it slides down to its shut-off position, as shown in FIGS. 2 and 7, and the tool 2 ceases to operate until the moil 92 is again placed on material on which it is to work. Thus, the tool 2 turns on and off automatically without the necessity for shutting off the hydraulic fluid pressure from the hydraulic system of the power equipment.

Throughout the description of the structure and operation of the preferred embodiment of the motor of this invention, the terms "upper" and "lower" have been used. These terms have been used for illustrative purposes only, illustrating a typical use attitude of the motor. The terms are not intended to indicate that the use attitude of the motor is limited to a vertical position in which the power stroke is downwardly directed, and it is intended to be understood that the motor of this invention can be used to advantage in other attitudes, including a horizontal attitude and a vertical attitude in which the power stroke is upwardly directed.

Similarly, the terms "up," "down", and the like have been used in reference to the movements of the hammer and the valve. Again, these terms have been used for illustrative purposes only. Their use is not intended to limit the possible use attitudes of the motor of this invention, nor is it intended to limit the possible variations in the structure, functioning, and orientation of the valving means.

It will be obvious to those skilled in the art to which this invention is addressed that the invention may be used to advantage in a variety of situations. Therefore, it is also to be understood by those skilled in the art that various changes, modifications, and omissions in form and detail may be made without departing from the spirit and scope of the present invention as defined by the following claims.

I claim:

1. In a motor of a type including a housing having a longitudinal cavity, and a linear piston which reciprocates in said cavity and which is driven by drive means in one direction toward a lower position and against a load and is moved in the opposite direction by a hydraulic system having a fluid inlet and a fluid outlet; said drive means including a body of incompressible fluid which is partially defined by an end portion of said cavity and which acts on and transmits a driving force to the piston, and spring means in pressure communication with said body:

stop means for automatically shutting off the motor when the load is removed from the piston; which stop means includes slide means for allowing the piston to slide past said lower position and into a shut-off position when the load is removed from the piston, and passageway means for short-circuiting hydraulic fluid pressure from the fluid inlet directly to the fluid outlet; said passageway means including a first end that is in open communication with the fluid inlet and that has an inlet opening ported on said end portion of the longitudinal cavity, and a second end that is in open communication with the fluid outlet and that has an outlet opening ported on said end portion of the longitudinal cavity; said inlet opening and said outlet opening being blocked from communication with each other by the piston when the motor is operating and in open communication with each other via the body of incompressible fluid when the piston is in its shut-off position; each of said openings being blocked by a side portion of the piston for at least a portion of the time the motor is operating to allow movement of the piston in said opposite direction to compress the spring means; and said outlet opening communicating with said body of fluid when the piston is in said lower position to prevent the drive means from exerting any driving force on the piston in said one direction.

2. A motor as recited in claim 1, in which said first end of the passageway means comprises an annular inlet passageway surrounding said end portion of the longitudinal cavity and communicating with the fluid inlet, and a plurality of such inlet openings ported on said end portion of the longitudinal cavity, which inlet openings are circumferentially spaced and communicate with the annular inlet passageway; and in which said second end of the passageway means comprises an annular outlet passageway surrounding said end portion of the longitudinal cavity and communicating with the fluid outlet, and a plurality of such outlet openings ported on said end portion of the longitudinal cavity, which outlet openings are circumferentially spaced and communicate with the annular outlet passageway.

3. A linear reciprocating motor comprising:

a housing including a longitudinal cavity, a fluid inlet, and a fluid outlet;

an elongated member having an upper position, a lower position, and a shut-off position, the lower position being intermediate between the upper position and the shut-off position;

drive means for forcibly moving the elongated member endwise through the longitudinal cavity toward its lower position and against a load; said drive means including an expansible fluid chamber formed by one end of the longitudinal cavity adjacent to the elongated member, and spring means in pressure communication with the fluid chamber, said spring means being compressed when pressure is applied to an incompressible fluid in the fluid chamber;

hydraulic means for driving the elongated member endwise through the longitudinal cavity toward its upper position; said hydraulic means including regulating means for alternately directing hydraulic fluid pressure from the fluid inlet against the elongated member to move said member toward its upper position, and exhausting hydraulic fluid pressure from the elongated member to allow the drive means to move said member toward its lower position; and stop means for automatically shutting off the motor when the load is removed from the elongated member; said stop means including slide means for allowing the elongated member to slide into its shut-off position when said load is removed, and passageway means for directly communicating the fluid inlet and the fluid outlet via the fluid chamber when the elongated member is in its shut-off position to create a short circuit and prevent hydraulic fluid pressure from being directed against the elongated member; said passageway means including an inlet opening ported on the fluid chamber and in open communication with the fluid inlet, and an outlet opening ported on the fluid chamber and in open communication with the fluid outlet; communication between said inlet opening and said outlet opening being open via the fluid chamber when the elongated member is in its shut-off position, and blocked by the elongated member when said member is in its upper or lower position or between said upper and lower positions; each of said openings being blocked by a side portion of the elongated member when said member is in its upper position or within a predetermined distance of its upper position; and said outlet opening communicating with the fluid chamber and the fluid outlet when the elongated member is in its lower position.

4. A linear reciprocating motor as described in claim 3, further comprising:

an exhaust manifold in open communication with the fluid outlet; and a check valve positioned between the fluid chamber and the exhaust manifold, which check valve opens in response to a lowering of hydraulic fluid pressure in the fluid chamber below the level of hydraulic fluid pressure in the exhaust manifold to admit hydraulic fluid into the fluid chamber, and is closed when the pressure in the fluid chamber is equal to or greater than the pressure in the exhaust manifold.

5. A linear reciprocating motor comprising:

a housing including a longitudinal cavity, a fluid inlet, and a fluid outlet;

an elongated member having an upper position, a lower position, and a shut-off position, the lower position being intermediate between the upper position and the shut-off position;

drive means for forcibly moving the elongated member endwise through the longitudinal cavity toward its lower position and against a load;

hydraulic means for driving the elongated member endwise through the longitudinal cavity toward its upper position; said hydraulic means including regulating means for alternately directing hydraulic fluid pressure from the fluid inlet against the elongated member to move said member toward its upper position, and exhausting hydraulic fluid pressure from the elongated member to allow the drive means to move said member toward its lower position; and stop means for automatically shutting off the motor when the load is removed from the elongated member; said stop means including slide means for allowing the elongated member to slide into its shut-off position when said load is removed, and passageway means for directly communicating the fluid inlet and the fluid outlet when the elongated member is in its shut-off position to create a short circuit and prevent hydraulic fluid pressure from being directed against the elongated member, said passageway means being blocked by the elongated member when said member is in its upper or lower position or between said upper and lower positions;

wherein:

the elongated member has an upper end confined in the longitudinal cavity;

the drive means includes an expansible fluid chamber formed by one end of the longitudinal cavity adjacent to said upper end of the elongated member; and the passageway means comprises an annular inlet passageway surrounding the end of the longitudinal cavity whch forms the fluid chamber, said annular inlet passageway communicating with the fluid inlet; a plurality of circumferentially spaced inlet openings communicating with the annular inlet passageway and ported on the longitudinal cavity; an annular outlet passageway surrounding the end of the longitudinal cavity which forms the fluid chamber, said annular outlet passageway communicating with the fluid outlet; and a plurality of circumferentially spaced outlet openings communicating with the annular outlet passageway and ported on the longitudinal cavity, communication between said inlet openings and said outlet openings being blocked by the elongated member when the passageway means is blocked and open via the fluid chamber when the elongated member is in its shut-off position.

6. A linear reciprocating motor comprising:

a housing including a longitudinal cavity defined in part by a transverse wall formed by the housing, a fluid inlet, a fluid outlet, a guide cavity spaced from the longitudinal cavity, and at least one pressure passageway communicating with the fluid inlet;

an elongated member having an upper position, a lower position, and a shut-off position, the lower position being intermediate between the upper position and the shut-off position; said elongated member including a galley portion, and a land portion adjacent to said galley portion; and said elongated member including a piston portion confined in the longitudinal cavity and having a pressure surface which, when the motor is operating, is spaced longitudinally from said transverse wall and in fluid communication therewith;

drive means for forcibly moving the elongated member endwise through the longitudinal cavity toward its lower position and against a load;

hydraulic means for driving the elongated member endwise through the longitudinal cavity toward its upper position; said hydraulic means including regulating means for alternately directing hydraulic fluid pressure from the fluid inlet against the elongated member to move said member toward its upper position, and exhausting hydraulic fluid pressure from the elongated member to allow the drive means to move said member toward its lower position; and stop means for automatically shutting off the motor when the load is removed from the elongated member; said stop means including slide means for allowing the elongated member to slide into its shut-off position when said load is removed, and passageway means for directly communicating the fluid inlet and the fluid outlet when the elongated member is in its shut-off position to create a short circuit and prevent hydraulic fluid pressure from being directed against the elongated member, said passageway means being blocked by the elongaed member when said member is in its upper or lower position or between said upper and lower positions;

in which the regulating means includes control valve means which reciprocates linearly between a first position in which hydraulic fluid pressure is admitted to the pressure surface for moving the elongated member toward its upper position and a second position in which hydraulic fluid pressure is exhausted from the pressure surface, and which has a first end surface which is in pressure communication with the fluid inlet and receives an endwise force from inflowing hydraulic fluid tending to move the control valve means into its first position; and conduit means for delivering hydraulic fluid pressure to the control valve means to move the control valve means into its second position and hold it there until the pressure surface has moved a predetermined distance toward the transverse wall as the elongated member moves toward its lower position;

in which the control valve means comprises a valve spool which reciprocates linearly in the guide cavity, and said first end surface of the control valve means comprises a first end surface of the valve spool;

which further comprises at least one pin having a pressure end which is closely received in the pressure passageway, and a contact end which makes contact with said first end surface of the valve spool; and in which the conduit means comprises a transmitting galley defined by said galley portion and the longitudinal cavity and in pressure communication with the fluid inlet; a first sidewall passageway with a first end directed toward the valve spool and a second end ported on the longitudinal cavity, said second end being closed when said land portion is adjacent to and in sliding contact with it and open when said land portion moves past it as the elongated member moves toward its upper position bringing said second end into communication with the transmitting galley and resulting in the delivery of hydraulic fluid pressure from the fluid inlet to the valve spool; a valve galley defined by a reduced width portion of the valve spool and a portion of the guide cavity; a pressure passageway which communicates the fluid inlet and the valve galley; a second sidewall passageway which communicates the valve galley and the transmitting galley; an expansible pressure galley surrounding a portion of the valve spool and defined in part by a transverse surface formed by an increased width portion of said spool, said pressure galley being in open communicating with said first end of said first sidewall passageway so that, when said second end of said first sidewall passageway is in communication with the transmitting galley, hydraulic fluid is delivered to said pressure galley and exerts a force on said transverse surface tending to move the valve spool into its second position and hold it there; and a third sidewall passageway having a first end ported on the longitudinal cavity below the second end of the first sidewall passageway, and a second end that communicates with the pressure galley when the valve spool is more than a predetermined distance from its first position and that is closed by the increased width portion of the valve spool when the valve spool is within said distance from its first position, said first end of said third sidewall passageway being adjacent to and closed by said land portion of the elongated member when said member is in its lower position and slidingly opening into communication with the transmitting galley as said member moves toward its upper position.

7. A linear reciprocating motor as described in claim 6 wherein:

a valve seat is formed by one end of the guide cavity;

the valve spool has a second end surface which sealingly contacts the valve seat when the valve spool is in its first position and is spaced from the valve seat when said spool is in its second position, a land portion adjacent to said second end surface, and an exhaust passage extending therethrough and ported on said first and second end surfaces, said exhaust passage being in open communication with the fluid outlet; and a portion of the longitudinal cavity forms an expansible drive chamber defined in part by said pressure surface and said transverse wall; said drive chamber being in communication with the valve galley when the valve spool is in its first position to admit hydraulic fluid pressure from the fluid inlet to the pressure surface and move the elongated member toward its upper position, and in communication with the exhaust passage when the valve spool is in its second position to exhaust hydraulic fluid pressure from the pressure surface through the exhaust passage to the fluid outlet, said land portion of the valve spool blocking the drive chamber from communication with the valve galley when said spool is in its second position.

8. A linear reciprocating motor as described in claim 7 wherein:

the elongated member has a reduced width portion which is adjacent to said land portion of said member and surrounded by an expansible exhaust galley which is formed by said reduced width portion of said member and a portion of the longitudinal cavity and is in open communication with the fluid outlet; and said second end of said first sidewall passageway opens into communication with the exhaust galley when said land portion of said member moves past said second end as the pressure surface approaches the transverse wall, resulting in the hydraulic fluid pressure being exhausted from said transverse surface and the valve spool being moved into its first position by hydraulic fluid pressure acting on the pressure end of said pin.

9. A linear reciprocating motor as described in claim 7 wherein the drive chamber contains an incompressible fluid when the motor is in operation, said fluid providing a cushioning stop for the elongated member as said member slides toward its shut-off position.

10. A linear reciprocating motor comprising:

a housing including a longitudinal cavity, a fluid inlet, and a fluid outlet;

an elongated member having an upper position, a lower position, and a shut-off position, the lower position being intermediate between the upper position and the shut-off position;

drive means for forcibly moving the elongated member endwise through the longitudinal cavity toward its lower position and against a load;

hydraulic means for driving the elongated member endwise through the longitudinal cavity toward its upper position; said hydraulic means including regulating means for alternately directing hydraulic fluid pressure from the fluid inlet against the elongated member to move said member toward its upper position, and exhausting hydraulic fluid pressure from the elongated member to allow the drive means to move said member toward its lower position; and stop means for automatically shutting off the motor when the load is removed from the elongated member; said stop means including slide means for allowing the elongated member to side into its shut-off position when said load is removed, and passageway means for directly communicating the fluid inlet and the fluid outlet when the elongated member is in its shut-off position to create a short circuit and prevent hydraulic fluid pressure from being directed against the elongated member, said passageway means being blocked by the elongated member when said member is in its upper or lower position or between said upper and lower positions;

wherein:

the elongated member has an upper end confined in the longitudinal cavity;

the drive means includes an expansible fluid chamber formed by one end of the longitudinal cavity adjacent to said upper end of the elongated member, and spring means in pressure communication with the fluid chamber, said spring means being compressed when pressure is applied to an incompressible fluid in the fluid chamber; and the passageway means includes an annular inlet passageway surrounding the end of the longitudinal cavity which forms the fluid chamber, said annular inlet passageway communicating with the fluid inlet; an annular outlet passageway surrounding said end of the longitudinal cavity, said annular outlet passageway communicating with the fluid outlet; a plurality of circumferentially spaced inlet openings ported on the longitudinal cavity and communicating with the fluid inlet via the annular inlet passageway; and a plurality of circumferentially spaced outlet openings ported on the longitudinal cavity and communicating with the fluid outlet via the annular outlet passageway; said inlet openings being in sliding contact with the elongated member when the passageway means is blocked and in open communication with the fluid chamber when the elongated member is in its shut-off position, and said outlet openings being in sliding contact with the elongated member when the elongated member is in its upper position and in open communication with the fluid chamber when the elongated member is in its lower position or its shut-off position.

11. In a spring powered impact tool of a type including a housing having a longitudinal cavity, and a linear hammer which reciprocates in said cavity and which is driven by drive means in one direction toward a lower position and into impacting contact with an impact member to drive said member against a load and is moved in the opposite direction by a hydraulic system having a fluid inlet and a fluid outlet; said drive means including a body of incompressible fluid which is partially defined by an end portion of said cavity and which acts on and transmits a driving force to the hammer, and spring means in pressure communication with said body:

stop means for automatically shutting off the tool when the load is removed from the impact member; which stop means includes slide means for allowing the impact member to slide into a shut-off position and the hammer to slide past said lower position and into a shut-off position when the load is removed from the impact member, and passageway means for short-circuiting hydraulic fluid pressure from the fluid inlet directly to the fluid outlet; said passageway means having a first end that is in open communication with the fluid inlet and that has an inlet opening ported on said end portion of the longitudinal cavity, and a second end that is in open communication with the fluid outlet and that has an outlet opening ported on said end portion of the longitudinal cavity; said inlet opening and outlet opening being blocked from communication with each other by the hammer when the tool is operating and in open communication with each other via the body of incompressible fluid when the hammer is in its shut-off position; each of said openings being blocked by a side portion of the hammer for at least a portion of the time the tool is operating to allow movement of the hammer in said opposite direction to compress the spring means; and said outlet opening communicating with said body of fluid when the hammer is in said lower position to prevent the drive means from exerting any driving force on the hammer in said one direction.

12. A spring powered impact tool as described in claim 11, in which the slide means comprises a longitudinal groove in the impact member having an inner surface and first and second ends, and a guide member projecting from the housing, which guide member is in sliding contact with the inner surface of the groove and is adjacent to said first end of the groove when the impact member is against a load and adjacent to said second end of the groove when the impact member is in its shut-off position.

13. An impact tool as recited in claim 11, in which said first end of the passageway means comprises an annular inlet passageway surrounding said end portion of the longitudinal cavity and communicating with the fluid inlet, and a plurality of such inlet openings ported on said end portion of the longitudinal cavity, which inlet openings are circumferentially spaced and communicate with the annular inlet passageway; and in which said second end of the passageway means comprises an annular outlet passageway surrounding said end portion of the longitudinal cavity and communicating with the fluid outlet, and a plurality of such outlet openings ported on said end portion of the longitudinal cavity, which outlet openings are circumferentially spaced and communicate with the annular outlet passageway.

14. A spring powered impact tool comprising:

a housing including a longitudinal cavity, a fluid inlet, and a fluid outlet;

a hammer that reciprocates linearly in the longitudinal cavity, and has an upper position, a lower position, and a shut-off position, the lower position being intermediate between the upper position and the shut-off position;

a linear impact member in line with the hammer and having a shut-off position;

drive means in line with the hammer for driving the hammer endwise through the longitudinal cavity toward its lower position and into impacting contact with the impact member, driving said member against a load; said drive means including an expansible fluid chamber formed by one end of the longitudinal cavity adjacent to the hammer, and spring means in pressure communication with the fluid chamber, said spring means being compressed when pressure is applied to an incompressible fluid in the fluid chamber;

a hammer return hydraulic system for driving the hammer endwise through the longitudinal cavity toward its upper position, said hydraulic system including regulating means for alternately directing hydraulic fluid pressure from the fluid inlet against the hammer to move the hammer toward its upper position, and exhausting hydraulic fluid pressure from the hammer to allow the drive means to move the hammer toward its lower position; and stop means for automatically shutting off the tool when the load is removed from the impact member; said stop means including slide means for allowing the impact member and the hammer to slide into their shut-off positions when said load is removed, and passageway means for directly communicating the fluid inlet and the fluid outlet via the fluid chamber when the hammer is in its shut-off position to create a short circuit and prevent hydraulic fluid pressure from being directed against the hammer; said passageway means including an inlet opening ported on the fluid chamber and in open communication with the fluid inlet, and an outlet opening ported on the fluid chamber and in open communication with the fluid outlet; communication between said inlet opening and said outlet opening being open via the fluid chamber when the hammer is in its shut-off position, and blocked by the hammer when the hammer is in its upper or lower position or between said upper and lower positions; each of said openings being blocked by a side portion of the hammer when the hammer is in its upper position or within a predetermined distance of its upper position; and said outlet opening communicating with the fluid chamber and the fluid outlet when the hammer is in its lower position.

15. A spring powered impact tool comprising:

a housing including a longitudinal cavity, a fluid inlet, and a fluid outlet;

a hammer that reciprocates linearly in the longitudinal cavity, and has an upper position, a lower position, and a shut-off position, the lower position being intermediate between the upper position and the shut-off position;

a linear impact member in line with the hammer and having a shut-off position;

drive means in line with the hammer for driving the hammer endwise through the longitudinal cavity toward its lower position and into impacting contact with the impact member, driving said member against a load;

a hammer return hydraulic system for driving the hammer endwise through the longitudinal cavity toward its upper position, said hydraulic system including regulating means for alternately directing hydraulic fluid pressure from the fluid inlet against the hammer to move the hammer toward its upper position, and exhausting hydraulic fluid pressure from the hammer to allow the drive means to move the hammer toward its lower position; and stop means for automatically shutting off the tool when the load is removed from the impact member; said stop means including slide means for allowing the impact member and the hammer to slide into their shut-off positions when said load is removed, and passageway means for directly communicating the fluid inlet and the fluit outlet when the hammer is in its shut-off position to create a short circuit and prevent hydraulic fluid pressure from being directed against the hammer, said passageway means being blocked by the hammer when the hammer is in its upper or lower position or between said upper and lower positions;

wherein:

the hammer has an upper end confined in the longitudinal cavity;

the drive means includes an expansible fluid chamber formed by one end of the longitudinal cavity adjacent to said upper end of the hammer; and the passageway means comprises an annular inlet passageway surrounding the end of the longitudinal cavity which forms the fluid chamber, said annular inlet passageway communicating with the fluid inlet; a plurality of circumferentially spaced inlet openings communicating with the annular inlet passageway and ported on the longitudinal cavity; an annular outlet passageway surrounding the end of the longitudinal cavity which forms the fluid chamber, said annular outlet passageway communicating with the fluid outlet; and a plurality of circumferentially spaced outlet openings communicating with the annular outlet passageway and ported on the longitudinal cavity, communication between said inlet openings and said outlet openings being blocked by the hammer when the passageway means is blocked and open via the fluid chamber when the hammer is in its shut-off position.

16. A spring powered impact tool as described in claim 15 wherein:

the inlet openings are in sliding contact with the hammer when the passageway means is blocked and in open communication with the fluid chamber when the hammer is in its shut-off position, and the outlet openings are in sliding contact with the hammer when the hammer is in its upper position and in open communication with the fluid chamber when the hammer is in its lower position or its shut-off position; and the drive means further includes spring means in pressure communication with the fluid chamber, said spring means being compressed when the hydraulic system moves the hammer toward its upper position and the upper end of the hammer past the outlet openings, closing said outlet openings and storing energy in the spring means for driving the hammer toward its lower position.

17. A spring powered impact tool comprising:

a housing including a longitudinal cavity, a fluid inlet, and a fluid outlet;

a hammer that reciprocates linearly in the longitudinal cavity, and has an upper position, a lower position, and a shut-off position, the lower position being intermediate between the upper position and the shut-off position;

a linear impact member in line with the hammer and having a shut-off position;

drive means in line with the hammer for driving the hammer endwise through the longitudinal cavity toward its lower position and into impacting contact with the impact member, driving said member against a load;

a hammer return hydraulic system for driving the hammer endwise through the longitudinal cavity toward its upper position, said hydraulic system including regulating means for alternately directing hydraulic fluid pressure from the fluid inlet against the hammer to move the hammer toward its upper position, and exhausting hydraulic fluid pressure from the hammer to allow the drive means to move the hammer toward its lower position; and stop means for automatically shutting off the tool when the load is removed from the impact member; said stop means including slide means for allowing the impact member and the hammer to slide into their shut-off positions when said load is removed, and passageway means for directly communicating the fluid inlet and the fluid outlet when the hammer is in its shut-off position to create a short circuit and prevent hydraulic fluid pressure from being directed against the hammer, said passageway means being blocked by the hammer when the hammer is in its upper or lower position or between said upper and lower positions;

wherein the slide means comprises a longitudinal groove in the impact member having an inner surface and first and second ends, and a guide member projecting from the housing, which guide member is in sliding contact with the inner surface of the groove and is adjacent to said first end of the groove when the impact member is against a load and adjacent to said second end of the groove when the impact member is in its shut-off position.

* * * * *

UNITED STATES PATENT AND TRADEMARK OFFICE

CERTIFICATE OF CORRECTION

PATENT NO. : 4,552,227

DATED : November 12, 1985

INVENTOR(S) : Maurice Wohlwend

It is certified that error appears in the above-identified patent and that said Letters Patent are hereby corrected as shown below:

Column 5, line 65, following "hydraulic", insert -- fluid --.

Column 6, lines 37 and 38, delete "This second end ported on the longitudinal cavity 12."

Column 10, line 53, "6" should be -- 96 --.

Column 15, line 12, "whch" should be -- which --.

Column 16, line 1, "elongaed" should be -- elongated --.

Column 16, line 55, "communicating" should be -- communication --.

Column 18, line 14, "side" should be -- slide --.

Signed and Sealed this

*Twenty-fourth* Day of *June 1986*

[SEAL]

*Attest:*

DONALD J. QUIGG

*Attesting Officer*

*Commissioner of Patents and Trademarks*